US011101565B2

(12) United States Patent
Wilson

(10) Patent No.: US 11,101,565 B2
(45) Date of Patent: Aug. 24, 2021

(54) LOW-PROFILE ANTENNA

(71) Applicant: NEPTUNE TECHNOLOGY GROUP INC., Tallassee, AL (US)

(72) Inventor: Michael A Wilson, Tallassee, AL (US)

(73) Assignee: Neptune Technology Group Inc., Tallassee, AL (US)

( * ) Notice: Subject to any disclaimer, the term of this patent is extended or adjusted under 35 U.S.C. 154(b) by 314 days.

(21) Appl. No.: 15/963,888

(22) Filed: Apr. 26, 2018

(65) Prior Publication Data

US 2019/0334242 A1 Oct. 31, 2019

(51) Int. Cl.
*H01Q 9/04* (2006.01)
*H01Q 1/38* (2006.01)

(52) U.S. Cl.
CPC ..... *H01Q 9/0414* (2013.01); *H01Q 1/38* (2013.01); *H01Q 9/0428* (2013.01)

(58) Field of Classification Search
CPC ..... H01Q 1/38; H01Q 9/0414; H01Q 9/0421; H01Q 9/0464; H01Q 9/0407
See application file for complete search history.

(56) References Cited

U.S. PATENT DOCUMENTS 4,218,682 A * 8/1980 Frosch ..... H01Q 9/0414 343/700 MS
4,316,194 A * 2/1982 De Santis ..... H01Q 9/0414 343/700 MS
4,401,988 A * 8/1983 Kaloi ..... H01Q 19/005 343/700 MS
4,434,425 A 2/1984 Barbano
4,987,421 A 1/1991 Sunahara et al.
5,099,249 A 3/1992 Seavey
5,337,060 A 8/1994 Harada
5,675,346 A 10/1997 Nishikawa et al.
5,703,601 A * 12/1997 Nalbandian ..... H01Q 9/0414 343/700 MS
6,133,878 A * 10/2000 Lee ..... H01Q 1/38 343/700 MS
6,198,439 B1 * 3/2001 Dufrane ..... H01Q 1/22 343/700 MS
6,252,549 B1 * 6/2001 Derneryd ..... H01Q 1/32 343/700 MS
6,806,831 B2 * 10/2004 Johansson ..... H01Q 9/0414 343/700 MS
6,812,902 B2 11/2004 Rossman et al.
6,850,191 B1 * 2/2005 Thill ..... H01Q 5/40 343/700 MS (Continued)

FOREIGN PATENT DOCUMENTS

CA 2057659 6/1992
EP 490760 6/1992

*Primary Examiner* — AB Salam Alkassim, Jr.
(74) *Attorney, Agent, or Firm* — Paul Sykes; Jake M. Gipson; Bradley Arant Boult Cummings LLP

(57) ABSTRACT

An improved low-profile antenna has a radiating element disposed apart from a ground plane, with at least one microstrip disposed between the radiating element and the ground plane. A feed is electrically coupled to the radiating element and to the at least one microstrip. The at least one microstrip is also electrically coupled to the ground plane, completing a closed path. When driven by an electrical signal, the antenna more efficiently generates electromagnetic signals in the horizontal direction and also has decreased sensitivity to foreign objects.

25 Claims, 4 Drawing Sheets

(56) References Cited

U.S. PATENT DOCUMENTS 6,959,529 B2 11/2005 Wubbels
7,190,310 B2 * 3/2007 Masutani ..... H01Q 9/0464 343/700 MS
7,283,101 B2 * 10/2007 Bisiules ..... H01Q 1/246 343/700 MS
7,498,989 B1 * 3/2009 Volman ..... H01Q 1/287 343/700 MS
8,193,989 B2 * 6/2012 Fujita ..... H01Q 1/007 343/700 MS
8,743,005 B2 * 6/2014 Stuart ..... H01Q 9/36 343/788
8,797,230 B2 8/2014 Leisten
8,836,503 B2 9/2014 Gelvin et al.
8,860,621 B2 10/2014 Zhang
8,994,594 B1 * 3/2015 Wilson ..... H01Q 9/0407 343/700 MS
10,381,747 B2 * 8/2019 Chien ..... H01Q 9/0414
2002/0171595 A1 * 11/2002 Schultze ..... H01Q 9/0414 343/770
2004/0174301 A1 * 9/2004 Aisenbrey ..... H01Q 9/0407 343/700 MS
2004/0263392 A1 * 12/2004 Bisiules ..... H01Q 9/0457 343/700 MS
2006/0007044 A1 * 1/2006 Crouch ..... H01Q 9/0435 343/700 MS
2006/0097924 A1 * 5/2006 Yegin ..... H01Q 9/0407 343/700 MS
2006/0139209 A1 * 6/2006 Tanaka ..... H01Q 9/0407 343/700 MS
2008/0158066 A1 7/2008 Yu et al.
2008/0266181 A1 * 10/2008 Ying ..... H01Q 1/241 343/700 MS
2009/0102723 A1 * 4/2009 Mateychuk ..... H01Q 5/40 343/700 MS
2009/0146894 A1 * 6/2009 Drexler ..... H01Q 1/38 343/757
2009/0273522 A1 * 11/2009 Tatarnikov ..... H01Q 9/0407 343/700 MS
2011/0175784 A1 * 7/2011 Moon ..... H01Q 9/16 343/816
2012/0212376 A1 * 8/2012 Jan ..... H01Q 9/0435 343/700 MS
2013/0278473 A1 10/2013 Bowers et al.
2015/0263431 A1 * 9/2015 Moon ..... H01Q 1/246 343/730
2018/0219292 A1 * 8/2018 Kenkel ..... H01Q 5/30
2018/0261929 A1 * 9/2018 Biscontini ..... H01Q 1/246
2018/0358701 A1 * 12/2018 Gimersky ..... H01Q 9/0414
2019/0081400 A1 * 3/2019 Hsu ..... H01Q 5/35
2021/0098877 A1 * 4/2021 Martel ..... H01Q 5/357

* cited by examiner

LOW-PROFILE ANTENNA

BACKGROUND OF THE INVENTION

The field of the present disclosure generally relates to electromagnetic propagation, and more particularly to antennas.

Antennas are an important part of wireless communication systems, which are becoming a more common and integral part of today's society. In these systems, the antenna facilitates the transmission and receipt of information by using electromagnetic waves. In a basic example, a feed source is connected to a transmitting antenna. The feed source provides an electrical signal, which represents the data to be transmitted. The electrical signal drives a radiating element in the transmitting antenna. The radiating element converts the electrical signal into electromagnetic signals, which radiate from the transmitting antenna. Those signals may be received by a receiving antenna. A receiving antenna essentially works in reverse: its radiating element converts the electromagnetic signals into electrical signals, which are transmitted to a receiver that can extract the data represented by the original signal. In many applications, an antenna performs both the transmitting and receiving functions.

Due to the myriad of wireless communication systems, antennas may be constructed using numerous structures. The structure of an antenna affects a variety of its properties, including its radiation pattern, directivity, gain, efficiency, and sensitivity. Directivity measures whether an antenna's power distribution is concentrated in a particular direction. Gain measures that amount of power that is transmitted in the direction of peak radiation. Efficiency describes how well an antenna converts an electrical signal into electromagnetic radiation. And sensitivity, as discussed herein, refers to an antenna's sensitivity to foreign objects, which may impair the transmission or reception of a signal.

Often, an antenna is designed with a structure that optimizes its various properties for a particular use case. For example, in terrestrial applications where an antenna is expected to ordinarily maintain a fixed orientation relative to the earth's surface (i.e. upright), it may be desirable that the antenna's radiation pattern causes its power to be distributed primarily in the outward (horizontal) direction instead of in the upward or downward (vertical) direction. Provided that both the transmitting and receiving antennas are located on or near the earth's surface (e.g. on a utility pole), this pattern is advantageous because it concentrates the radiated signals in the horizontal direction where a receiving antenna should be located. This characteristic therefore improves the performance of the antenna.

Further, in many terrestrial applications, it may be desirable that an antenna distribute its power equally throughout the horizontal direction. This characteristic is sometimes referred to as omnidirectional. It may be desirable, for instance, where the receiving antenna could be located in any direction relative to the transmitting antenna. Thus, because the direction of the receiving antenna will be unknown, an omnidirectional power distribution minimizes the chance that the receiving antenna may be located in a direction where the signal strength is weak.

A traditional dipole antenna is an example of an antenna that may provide the characteristics desirable in these terrestrial applications. But dipole antennas have their own drawbacks. In particular, dipole antennas tend to be larger in size and fragile. As a result, dipole antennas may be problematic in many use cases. For instance, dipole antennas may not be desirable where the antenna must be installed on or near the ground, or where the antenna is likely to encounter people, vehicles, or other objects.

To address these concerns with dipole designs, various antennas have been developed that are low profile, more durable, and exhibit the desired radiation pattern. An example of such an antenna is that taught by the same inventor as the present invention in U.S. Pat. No. 8,994,594 ("Ring Dipole Antenna"). As taught therein, the antenna comprises an annular radiating element; a ground plane; a plurality of radial microstrips having an inner end and an outer end, the outer ends coupled to the radiating element and the inner ends coupled to the ground plane; and a feed located in the center of the radiating element and coupled to each radial microstrip between the inner end and the outer end. This antenna structure results in a power distribution in which the power of the electromagnetic signal is directed primarily in the radial (horizontal) direction. An antenna of this design is also compact: it is a fraction of the height of a comparable dipole antenna, with some embodiments having a thickness of approximately $1/10\ \lambda$ and a diameter of approximately $1/4\ \lambda$.

Nonetheless, challenges still remain to improve the performance of low profile antennas. One such challenge is improving the radiation efficiency. Improved efficiency is theoretically possible. But in prior art antennas, the radial signal strength is limited due to the ground connection causing a shorting effect that impairs the radiation of the radio frequency field.

A second and related challenge is the antenna's sensitivity to foreign objects, which may impact the antenna's radiation performance. A foreign object, for instance a leaf, is problematic because it may exacerbate the shorting effect described above. This occurs when the foreign object is in contact with both the radiating element and the ground connection. And this effect will become more pronounced as the foreign objection becomes more conductive, such as when a leaf becomes wet. This concern is of particular importance where an antenna is intended to be installed on or near the ground and to be physically monitored on an infrequent basis. In such an installation, foreign objects may come into contact with the antenna unknowingly and may impact the antenna's performance for extended periods of time.

Consequently, there exists a need in the art for a low-profile antenna that provides an omnidirectional power distribution in primarily the horizontal direction, that provides improved radiation efficiency, and that has reduced sensitivity to foreign objects.

SUMMARY OF THE INVENTION

The present disclosure describes an improved low-profile antenna with advantages over previous designs. Embodiments of the antenna are low profile and provide a radiation pattern that distributes power primarily in the horizontal direction. Advantageously, due to the configuration of its components, the radiation efficiency of the antenna is improved over comparably sized low-profile antennas and more comparable to the efficiency associated with traditional dipole antennas. The antenna also has reduced sensitivity to presence of foreign objects. Embodiments of the invention may satisfy one or more, but not necessarily all, of the needs and capabilities described throughout this disclosure.

In a first aspect, an antenna is provided comprising a radiating element; a ground plane apart from the radiating element; at least one microstrip disposed between and apart from the radiating element and the ground plane, each microstrip having a feed end and a grounded end, wherein each grounded end is coupled to the ground plane; and a feed, the feed coupled to the radiating element and coupled to the feed end of each said microstrip.

In a second aspect, an antenna is provided comprising a radiating element; a ground plane apart from the radiating element; a plurality of microstrips disposed approximately halfway between and apart from the radiating element and the ground plane, each microstrip having a feed end and a grounded end, wherein each grounded end is coupled to the ground plane; and a feed, the feed coupled to the radiating element and coupled to the feed end of each said microstrip; wherein the antenna has a resonant frequency defining a wavelength, wherein the radiating element has a diameter that is no greater than about ⅖ of the wavelength, wherein the distance between the radiating element and the ground plane is less than about 1/10 of the wavelength, and wherein the perimeter of the ground plane extends beyond the perimeter of the radiating element by a distance that is no less than the distance between the radiating element and the ground plane.

The above summary presents a simplified summary to provide a basic understanding of some aspects of the claimed subject matter. This summary is not an extensive overview. It is not intended to identify key or critical elements or to delineate the scope of the claimed subject matter. Its sole purpose is to present some concepts in a simplified form as a prelude to the more detailed description that is presented later.

DEFINITIONS

Figure 1:
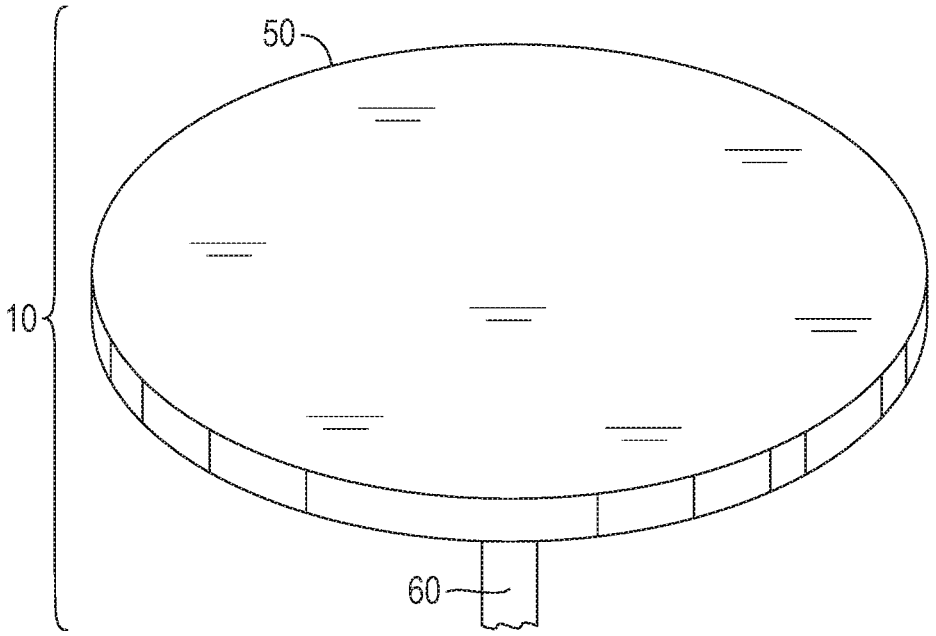
FIG. 1: A perspective view of one embodiment of the improved antenna.

Unless otherwise defined, all terms is (including technical and scientific terms) used herein have the same meaning as commonly understood by one of ordinary skill in the art of this disclosure. It will be further understood that terms, such as those defined in commonly used dictionaries, should be interpreted as having a meaning that is consistent with their meaning in the context of the specification and should not be interpreted in an idealized or overly formal sense unless expressly so defined herein. Well known functions or constructions may not be described in detail for brevity or clarity.

The terms "about" and "approximately" shall generally mean an acceptable degree of error or variation for the quantity measured given the nature or precision of the measurements. Typical, exemplary degrees of error or variation are within 20 percent (%), preferably within 10%, and more preferably within 5% of a given value or range of values. Numerical quantities given in this description are approximate unless stated otherwise, meaning that the term "about" or "approximately" can be inferred when not expressly stated.

The terminology used herein is for the purpose of describing particular embodiments only and is not intended to be limiting. As used herein, the singular forms "a," "an," and "the" are intended to include the plural forms, unless the context clearly indicates otherwise.

The terms "first," "second," and the like are used herein to describe various features or elements, but these features or elements should not be limited by these terms. These terms are only used to distinguish one feature or element from another feature or element. Thus, a first feature or element discussed below could be termed a second feature or element, and similarly, a second feature or element discussed below could be termed a first feature or element without departing from the teachings of the present disclosure.

Spatially relative terms, such as "under," "below," "lower," "over," "upper," and the like, may be used for ease of reference to describe one element or an element's relationship to other elements when the antenna is positioned in the horizontal position (i.e. right side up).

The term "consisting essentially of" means that, in addition to the recited elements, what is claimed may also contain other elements (steps, structures, ingredients, components, etc.) that do not adversely affect the operability of what is claimed for its intended purpose as stated in this disclosure. This term excludes such other elements that adversely affect the operability of what is claimed for its intended purpose as stated in this disclosure, even if such other elements might enhance the operability of what is claimed for some other purpose.

It is to be understood that any given elements of the disclosed embodiments of the invention may be embodied in a single structure, a single step, a single substance, or the like. Similarly, a given element of the disclosed embodiment may be embodied in multiple structures, steps, substances, or the like.

The following description illustrates and describes the processes, machines, manufactures, compositions of matter, and other teachings of the present disclosure. Additionally, the disclosure shows and describes only certain embodiments of the processes, machines, manufactures, compositions of matter, and other teachings disclosed, but as mentioned above, it is to be understood that the teachings of the present disclosure are capable of use in various other combinations, modifications, and environments and is capable of changes or modifications within the scope of the teachings as expressed herein, commensurate with the skill and/or knowledge of a person having ordinary skill in the relevant art. The embodiments described are further intended to explain certain best modes known of practicing the processes, machines, manufactures, compositions of matter, and other teachings of the present disclosure and to enable others skilled in the art to utilize the teachings of the present disclosure in such, or other, embodiments and with the various modifications required by the particular applications or uses. Accordingly, the processes, machines, manufactures, compositions of matter, and other teachings of the present disclosure are not intended to limit the exact embodiments and examples disclosed herein. Any section headings herein are provided only for consistency with the suggestions of 37 C.F.R. § 1.77 or otherwise to provide organizational cues. These headings shall not limit or characterize the invention(s) set forth herein.

DETAILED DESCRIPTION

An improved low-profile antenna has been developed and is disclosed. FIGS. 1-4 show one embodiment of the invention. As shown, the antenna 10 comprises a radiating element 15, a ground plane 20, a feed 25, and at least one microstrip 30. The radiating element 15 lies in a plane parallel to the ground plane 20, with the ground plane 20 disposed below the radiating element 15 in the orientation as shown. The at least one microstrip 30 is disposed between the radiating element 15 and the ground plane 20 with the at least one microstrip spaced apart from each. The feed 25 is electrically coupled to the radiating element 15 and the at least one micro strip 30 at a feed point 35. Each microstrip 30 is also electrically coupled to the ground plane 20. The components of the antenna 10 and other aspects will now be described in greater detail.

The radiating element 15 may be any suitable shape, with regular shapes generally providing performance that is more desirable than an irregular shape. As shown, the radiating element 15 is a circular disk, which is particularly advantageous where an omnidirectional antenna is desirable. But in other embodiments, the radiating element 15 may be another shape, such as polygonal. The feed point 35 is preferably located in the center of the radiating element 15.

Figure 2:
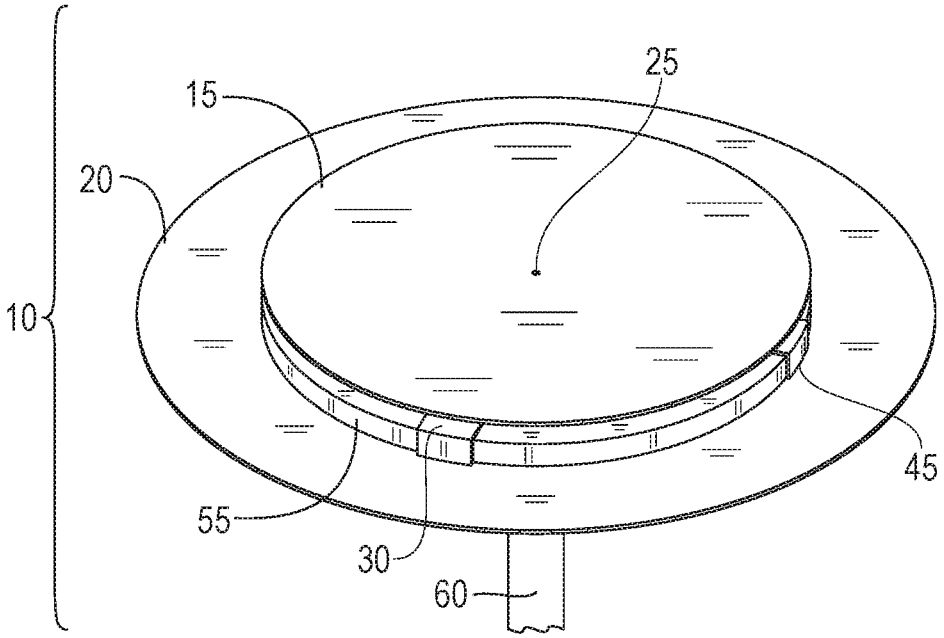
FIG. 2: A perspective view of one embodiment of the improved antenna, with the antenna housing removed.
Figure 3:
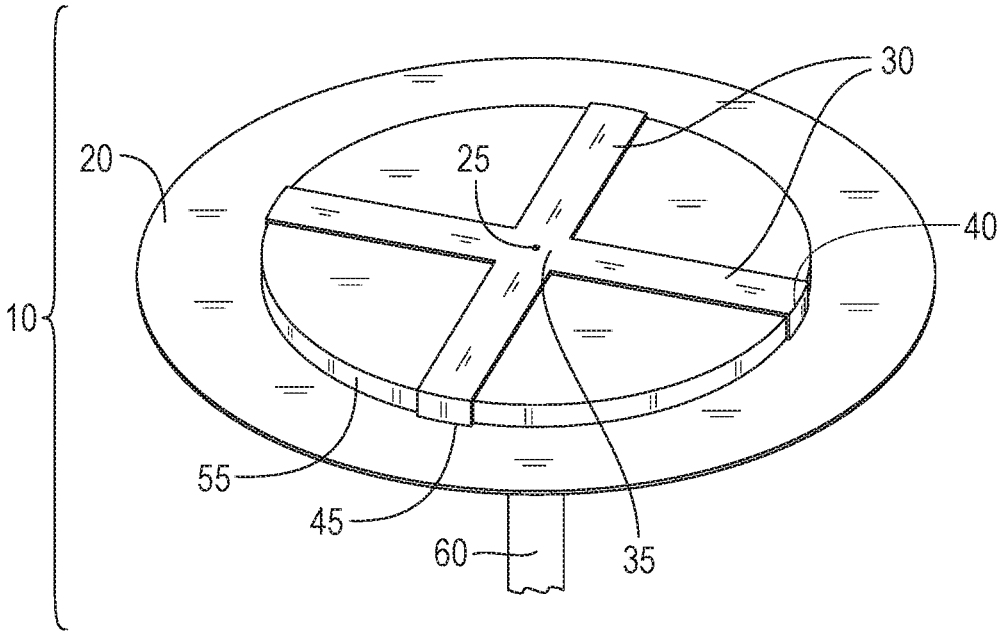
FIG. 3: A perspective view of one embodiment of the improved antenna, with the antenna housing and the radiating element removed.

The ground plane 20 may also be any suitable shape, but in many embodiments, its shape corresponds to the shape of the radiating element 15. The ground plane 20 need not, however, have the same dimensions as the radiating element 15. Advantageously, the ground plane 20 may extend beyond (e.g. have a greater diameter than) the radiating element 15. Preferably, the ground plane 20 extends beyond the radiating element 15 by a distance that is equal to or greater than the vertical distance between the ground plane 20 and the radiating element 15. As shown in FIG. 2, the ground plane 20 is a circular disk with a radius that is slightly greater than the radius of the radiating element 15.

Each of the at least one microstrips 30 extends radially outward from the feed point 35 to a ground connection 45. The microstrips 30 may be any suitable structure, with FIGS. 2-3 providing one example. As shown, the antenna 10 has four microstrips 30 that are coupled together near the feed point 35 and that are spaced equidistantly apart by approximately 90°. The feed point 35 coincides with the center of the radiating element 15. Each microstrip 30 is a strip of conductive material having approximately uniform width throughout its length. Throughout the major portion of its length (starting at the feed point 35 and extending to a bend 40), each microstrip 30 lies in a plane that is parallel to the planes containing the radiating element 15 and the ground plane 20. The major portion of each microstrip 30 extends slightly farther than the radius of the radiating element 15. Thus, the bend 40 and ground connection 45 are located slightly beyond the perimeter of the radiating element 15. At the bend 40, each microstrip 30 turns downward toward the ground plane 20. At the end of the bent section, each microstrip 30 forms a ground connection 45 with the ground plane 20. The microstrips 30 of this embodiment may be stamped from a single sheet of metal, with the bend 40 of each microstrip being formed by bending or crimping each microstrip 30 downward at a distance from the end of the microstrip that equals the desired distance between the microstrips 30 and the ground plane 20.

Numerous variations are possible for the structure of the microstrips 30. The microstrips 30 may have a varying width, such as a taper from wider at the feed point 35 to narrower at the ground connection 45. The feed point 35, where the microstrips 30 are coupled together, may also be offset from the center of the radiating element 15. Optionally, the microstrips 30 may be non-parallel with the radiating element 15 and the ground plane 20. For instance, the microstrips 30 may be angled downward toward the ground plane 20 through the majority of their length. The microstrips 30 may continue at a downward angle until reaching a bend 40 or until reaching the ground plane itself 20 (there is no bend). On the other hand, in embodiments where the microstrips 30 are parallel, the microstrips 30 may be disposed at any location in between the radiating element 15 and the ground plane 20. In some preferred embodiments, the microstrips 30 are spaced approximately half way between the radiating element 15 and the ground plane 20. The length of the microstrips 30 may also vary between embodiments, which may result in the bend 40 falling outside of, inside of, or in line with the perimeter of the radiating element 15. The antenna 10 may also contain any number of microstrips 30, with the number being any of, or between, 1, 2, 3, 4, 6, 10, 20, 50, 100, or even more. Alternatively, the microstrip 30 may comprise one solid disk, with a bend 40 and a downward portion forming a ground connection 45. In such an embodiment, the bend 40 and the ground connection 45 may be located along the entire perimeter of the disk or at only select locations along the perimeter of the disk. Each of the foregoing properties of the microstrips 30 may be modified to achieve better impedance matching to the feed source.

The dimensions of the microstrips 30 and the location of the bend 40 vis-à-vis the perimeter of the radiating element 15 may also help to determine operating frequency. Those characteristics affect operating frequency because they affect the signal path distance, which is the distance the signal must propagate from the perimeter of the radiating element 15 through the feed point 35 and to the ground connection 45 of the microstrip 30. Further, the location of the feed point 35 along the signal path distance affects the amount of impedance of the antenna 10 that will match the input impedance. Thus, the microstrips 30 and the radius of the radiating element 15 may be altered to lengthen or shorten the signal path distance and change the relative location of the feed point 35, which will affect the resonant frequency and impedance matching. In some preferred embodiments, the signal path distance is approximately one half of the desired resonant frequency. Other preferred embodiments include operation at harmonics in which the signal path distance is approximately one third or another fraction of the desired resonant frequency.

The feed 25 couples the antenna 10 to a feed source. The feed 25 may be any connection that directly or capacitively couples the feed source to the radiating element 15 and to the at least one microstrip 30. Preferably, the feed 25 is a standard connector that allows the antenna 10 to couple to a standard coaxial cable 60. In this embodiment, the feed 25 comprises a central conductor and an outer sheath of conductors. At one end, the central conductor couples to the central conductor of the coaxial cable 60, and at the other end (the feed point 35), it couples to the radiating element 15 and the at least one microstrip 30. Thus, when the feed source transmits an input signal through the coaxial cable, the central conductor of the feed 25 carries that input signal to the feed point 35. The outer sheath of conductors are coupled at one end to the ground plane 20 and at the other end to the outer sheath of the coaxial cable 60. The outer sheath of conductors thus provides a return path for the input signal. The central and outer conductors are separated by an insulator and constructed as is known by those of ordinary skill in the art. It should be understood, however, that the feed 25 may be any other suitable connector for connecting an input source to the antenna 10. For instance, the feed 25 may comprise hard wired connections to the feed source.

Figure 4:
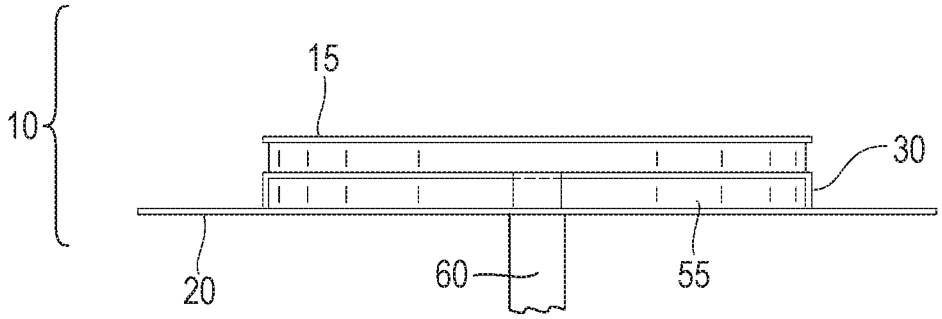
FIG. 4: A side view of one embodiment of the improved antenna, with the antenna housing removed.
Figure 5:
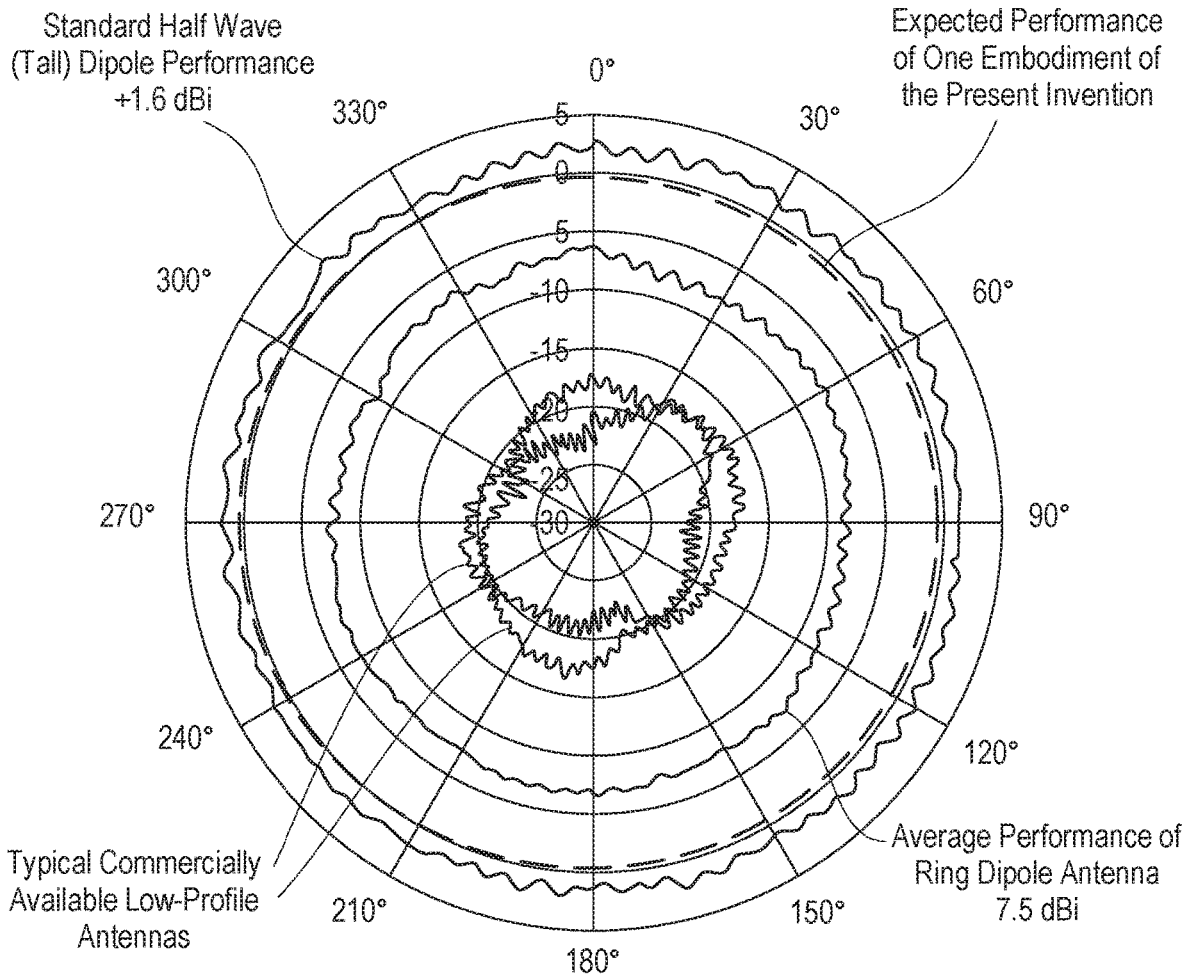
FIG. 5: An exemplary chart comparing the radiation performance in the horizontal direction of one embodiment of the improved antenna versus the radiation performance of other low-profile antennas and a traditional dipole antenna.

The components of the antenna 10 are contained within an antenna housing 50. The housing 50 may be constructed from any suitable material, such as a semi-transparent plastic. As mentioned above, the at least one microstrip 30 is disposed between the ground plane 20 and the radiating element 15. In most embodiments, that means there is space between the at least one microstrip 30 and the ground plane 20, and space between the at least one microstrip 30 and the radiating element 15. In a preferred embodiment, the at least one microstrip 30 is disposed approximately half way between the radiating element 15 and the ground plane 20. But in other embodiments, the at least one microstrip 30 may be disposed closer to the radiating element 15 or closer to the ground plane 20. As shown in FIG. 4, the space between the radiating element 15, the at least one microstrip 30, and the ground plane 20 may be filled with a solid or semi-solid dielectric material 55. In some embodiments, the entire housing 50 is filled with dielectric materials. But in other embodiments, the space may be filled entirely with air, or with a combination of air and dielectric materials.

As with any antenna, the antenna 10 described in the above embodiment has a resonant frequency $f_r$ that is a function of the materials and structure of the antenna. Certain dimensions of antennas are often expressed in terms of the wavelength λ at the resonant frequency. For example, a quarter-wave dipole antenna refers to a dipole antenna with a length that is one-fourth as long as the wavelength λ of the signal propagated at the resonant frequency $f_r$. In a preferred embodiment, radiating element 15 is a disk with a diameter of approximately, ¼ λ. Further, the height of the antenna 10 (the distance between the radiating element 15 and the ground plane 20) is about 1/20 λ. This small profile is particularly advantageous in use cases where the antenna is likely to encounter passing pedestrians, vehicles, lawnmowers, and other equipment.

Additionally, the operating frequency of the antenna 10 may be affected by the signal path distance from the perimeter of the radiating element 15 through the feed point 35 and to the ground connection 45. In some preferred embodiments, the signal path distance is approximately ¼ λ. In designs where the radiating element 15 has a small diameter as compared to the operating wavelength (e.g. a diameter of approximately ¼ λ), the desired signal path distance may be achieved by locating the bend 40 near the perimeter of the radiating element 15 so long as the microstrip 30 is also straight. But in embodiments where the ground is connected by a convoluted path (e.g. the microstrip 30 may not be straight), the desirable location of the bend 40 may be inside of the perimeter of the radiating element 15.

The location of the feed point 35 also affects matching the impedance of the antenna 10 to the input impedance of the feed source. Even if the impedance of the antenna 10 and the input impedance are not the same, they may be suitably matched by adjusting the ratio of the distance from the feed point 35 to the perimeter of the radiating element 15 divided by the distance from the feed point 35 to the ground connection 45. That is, different input impedances may be matched by changing the radius of the radiating element 15 to be longer or shorter as compared to the length of the microstrips 30. Thus, two antennas with similar signal path distances, similar resonant frequencies, and similar impedances may be well impedance matched to two different input impedances based on the antennas having a different relative location of feed point 35. For instance, in embodiments where it is desirable to have a signal path distance of approximately ¼ λ, the antenna 10 may be impedance-matched to the source by increasing (or in other cases decreasing) the diameter of the radiating element 15 to be slightly greater than (or perhaps less than) ¼ λ and by correspondingly decreasing (or perhaps increasing) the length of the microstrips 30. In an exemplary embodiment, the ratio of the radius of the radiating element 15 to the length of the microstrips 30 is a function of, and may be directly proportional to, the ratio of the antenna's impedance to the input impedance.

Embodiments of this antenna 10 have many advantages. For instance, an electromagnetic signal propagates uniformly from the radiating element 15, with its power oriented primarily radially, rather than axially, with respect to the radiating element 15. The power distribution of the signal is approximately toroidal in shape, with its peak power found at about the horizon. The power decreases slowly as the elevation angle Φ increases from horizontal, with the radiated power approaching zero as Φ approaches 90°. This power distribution is advantageous over many traditional patch antennas, which ordinarily have their peak power around 45° from horizontal and relatively little power at lower angles that are closer to horizontal. As a result, embodiments of the antenna 10 disclosed herein may be more suitable for transmitting to terrestrially based receivers, such as those located on telephone or power poles, buildings, and the like. Power is not wasted in such applications by being transmitted axially, or vertically, from the radiating element 15.

Embodiments of this antenna 10 also provide increased performance over other low-profile antenna designs. FIG. 4 provides an exemplary chart that compares the average performance of one embodiment of the antenna 10 to the performance of other low-profile antennas and to the performance of a standard half-wave dipole antenna. For each antenna, the chart depicts the radiation strength of the antenna throughout 360° in the horizontal direction. As shown, the performance of the antenna 10 is much improved over the performance of previous low-profile antennas. Indeed, the improved low-profile antenna 10 has performance that is much closer to the performance associated with a traditional half-wave dipole. This improvement is particularly advantageous because a wireless system may use the antenna to transmit further distances using the same amount of power as previous low-profile designs. Or it may use less power to transmit the same distance.

The antenna 10 is also less sensitive to foreign objects, such as a wet leaf. That decreased sensitivity is due to the ground connection 45 being located below the radiating element 15. So unlike previous antenna designs where the ground being above the radiating element is more apt to external influence, a foreign object like a wet leaf cannot easily form a short circuit between the ground connection 45 and the radiating element 15 of the antenna 10.

Embodiments of the present invention therefore find application where the size and footprint of an antenna are important, and in which the targeted receivers of the antenna's signal are displaced substantially horizontally, rather than vertically, from the antenna. The antenna is relatively flat (with most embodiments being less than about 1/10λ tall, and more preferably less than about 1/20 λ tall) and has a small profile (with most embodiments being less than ½ λ in diameter, and preferably a diameter of no greater than ⅖ λ, and more preferably a diameter of less than or equal to ¼ λ). These embodiments are also particularly advantageous in systems where high efficiency is needed and where monitoring of the antenna may be infrequent.

One exemplary application is use as a pit antenna in an automated water metering system. Water meters are often located in a small depression, or pit, on the customer's premises. The meter may be equipped with a meter interface unit (MIU) that automatically records the meter readings and transmits them to a collecting device located on a telephone or power pole. One such collector may service thousands of MIUs. Because the MIUs are located at or near ground level, and the collector is located at a relatively low angle Φ relative to horizontal from the MIUs, an antenna having the power distribution characteristics of antenna 10 is advantageous. Further, the compact size and flat shape of the antenna 10 allows it to be integrated into the lid of the meter or otherwise fitted safely and securely into the meter pit. The antenna 10 is also particularly advantageous with battery operated MIUs due to its increased radiation efficiency, which allows the MIU to achieve the same communications while consuming less battery. Additionally, the antenna's decreased sensitivity to foreign objects is desirable because operators prefer to inspect MIUs on an infrequent basis. The antenna 10 is thus less likely to become impaired.

While the invention has been described with respect to a limited number of embodiments, those skilled in the art, having benefit of this disclosure, will appreciate that other embodiments can be devised which do not depart from the scope of the invention as disclosed here.

I claim:

1. An antenna comprising:

a radiating element;

a ground plane apart from said radiating element and defining a space therebetween;

a plurality of microstrips disposed in said space, each microstrip having a feed end and a grounded end, wherein each grounded end is coupled to said ground plane; and a feed, said feed connected to said feed end of each said microstrip and passing therethrough to connect to said radiating element.

2. The antenna of claim 1, wherein said radiating element is a disk.

3. The antenna of claim 2, wherein said antenna has a resonant frequency defining a wavelength, and wherein said radiating element has a diameter that is no greater than about ½ of said wavelength.

4. The antenna of claim 3, wherein said radiating element has a diameter that is no greater than about ⅖ of said wavelength.

5. The antenna of claim 3, wherein said radiating element has a diameter that is about ¼ of said wavelength.

6. The antenna of claim 1, wherein said radiating element lies in a plane parallel to said ground plane.

7. The antenna of claim 6, wherein said at least one of said plurality of microstrips has a bend, a major portion of said at least one microstrip being between said feed end and said bend, said major portion lying in a plane parallel to said radiating element.

8. The antenna of claim 7, wherein said major portion is disposed approximately half way between said radiating element and said ground plane.

9. The antenna of claim 1, wherein said grounded end is positioned near the perimeter of said radiating element.

10. The antenna of claim 1, wherein said antenna has a resonant frequency defining a wavelength, and wherein the signal path distance from the perimeter of said radiating element to said grounded end is approximately ¼ of said wavelength.

11. The antenna of claim 1, wherein said antenna has a resonant frequency defining a wavelength, and wherein the distance between said radiating element and said ground plane is less than about 1/10 of said wavelength.

12. The antenna of claim 11, wherein the distance between said radiating element and said ground plane is less than about 1/20 of said wavelength.

13. The antenna of claim 1, wherein said feed has an input impedance and said antenna has an impedance, wherein said antenna has a matching ratio calculated as the radius of said radiating element divided by the length of one of said plurality of microstrips, and wherein said matching ratio is selected to approximately match said impedance of said antenna to said input impedance.

14. The antenna of claim 13, wherein said matching ratio is a function of said impedance of said antenna divided by said input impedance.

15. The antenna of claim 1, wherein the perimeter of said ground plane extends beyond the perimeter of said radiating element by a distance that is no less than the distance between said radiating element and said ground plane.

16. The antenna of claim 1, wherein said each of said plurality of microstrips is spaced equidistantly apart.

17. The antenna of claim 1, wherein said antenna further comprises dielectric material between said radiating element and said ground plane.

18. The antenna of claim 16, wherein said antenna further comprises dielectric material between said plurality of microstrips and said radiating element.

19. An antenna comprising:

a radiating element;

a ground plane apart from said radiating element and defining a space therebetween;

a plurality of microstrips disposed approximately halfway in said space, each microstrip having a feed end and a grounded end, wherein each grounded end is coupled to said ground plane; and a feed, said feed connected said feed end of each said microstrip and passing therethrough to connect to said radiating element;

wherein said antenna has a resonant frequency defining a wavelength, wherein said radiating element has a diameter that is no greater than about ⅖ of said wavelength, wherein the distance between said radiating element and said ground plane is less than about 1/10 of said wavelength, and wherein the perimeter of said ground plane extends beyond the perimeter of said radiating element by a distance that is no less than the distance between said radiating element and said ground plane.

20. The antenna of claim 19, wherein said grounded end is positioned near the perimeter of said radiating element.

21. The antenna of claim 19, wherein the signal path distance from the perimeter of said radiating element to said grounded end is approximately ¼ of said wavelength.

22. An antenna comprising:

a radiating element;

a ground plane apart from said radiating element and defining a space therebetween;

a plurality of microstrips disposed in said space, each microstrip having a feed end and a grounded end, wherein each grounded end is coupled to said ground plane; and a feed, said feed connected said feed end of each said microstrip and passing therethrough to connect to said radiating element, said feed having an input impedance;

wherein said antenna has a resonant frequency defining a wavelength and has an impedance, wherein said antenna has a matching ratio calculated as the radius of said radiating element divided by the length of one of said plurality of microstrips, and wherein said matching ratio is a function of said impedance of said antenna divided by said input impedance.

23. The antenna of claim 22, wherein the signal path distance from the perimeter of said radiating element to said grounded end is approximately ½ of said wavelength.

24. The antenna of claim 22, wherein the signal path distance from the perimeter of said radiating element to said grounded end is approximately ⅓ of said wavelength.

25. The antenna of claim 22, wherein the signal path distance from the perimeter of said radiating element to said grounded end is approximately ¼ of said wavelength.

* * * * *